US010786045B2

(12) United States Patent
Ben-Arie

(10) Patent No.: US 10,786,045 B2
(45) **Date of Patent: *Sep. 29, 2020**

(54) LACE RATCHETING DEVICE—METAL JACKET

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/550,345

(22) Filed: Aug. 26, 2019

(65) Prior Publication Data

US 2019/0380445 A1 Dec. 19, 2019

Related U.S. Application Data

(63) Continuation of application No. 15/722,755, filed on Oct. 2, 2017, now Pat. No. 10,390,590, which is a continuation-in-part of application No. 15/207,517, filed on Jul. 12, 2016, now Pat. No. 9,808,050.

(51) Int. Cl.
*A43C 7/08* (2006.01)

(52) U.S. Cl.
CPC ..... *A43C 7/08* (2013.01)

(58) Field of Classification Search
CPC ..... A43C 7/04; A44B 11/125; A44B 11/14
See application file for complete search history.

(56) References Cited

U.S. PATENT DOCUMENTS 1,279,043 A * 9/1918 Treadgold ..... A43C 7/04 24/712.6
1,489,117 A * 4/1924 De Paye ..... A43C 7/00 24/712.6
1,520,716 A * 12/1924 Judd ..... H02G 1/02 24/134 P
2,131,454 A * 9/1938 Prestinari ..... A44C 5/185 24/265 R
3,225,402 A * 12/1965 Altman ..... A43C 7/04 24/712.6
4,071,964 A 2/1978 Vogiatzis
4,125,918 A 11/1978 Baumann
4,130,949 A 12/1978 Seidel
4,261,081 A 4/1981 Lott
4,458,373 A 7/1984 Maslow
4,507,878 A 4/1985 Semouha
4,616,432 A 10/1986 Bunch
4,648,159 A 3/1987 Dougherty
4,991,273 A 2/1991 Huttle
(Continued)

*Primary Examiner* — Robert Sandy
*Assistant Examiner* — David M Upchurch

(57) ABSTRACT

The Lace Ratchet Device (LRD) facilitates lace fastening and release. The LRD has two states: "active" and "inactive". In the active position the device works as a lace ratchet allowing the lace to be pulled forwards but restricting any lace motion backwards. After fastening the lace remains fastened until the LRD is switched into inactive state by manually pressing a lever. Each LRD has a turning gate rotatably installed diagonally in a channel with front end which is covered with sheet metal with sharp edge. A preloaded spring keeps the LRD in active position while the lever is not pressed. The LRD doesn't employ serrated blades which cause accelerated lace wear. Instead, the LRD's smooth front edge side and channel surfaces minimize lace wear. LRD pairs are suitable for fastening footwear and can be coupled with a clasp which locks dangling laces' front ends.

19 Claims, 7 Drawing Sheets

(56) References Cited

U.S. PATENT DOCUMENTS

| | | | | |
|---|---|---|---|---|
| 5,001,847 | A | 3/1991 | Waters | |
| 5,097,573 | A | 3/1992 | Gimeno | |
| 5,109,581 | A | 5/1992 | Gould | |
| 5,119,539 | A | 6/1992 | Curry | |
| 5,177,882 | A | 1/1993 | Berger | |
| 5,203,053 | A | 4/1993 | Rudd | |
| 5,230,171 | A | 7/1993 | Cardaropoli | |
| 5,293,669 | A | 3/1994 | Sampson | |
| 5,293,675 | A | 3/1994 | Shai | |
| 5,295,315 | A | 3/1994 | Osawa | |
| 5,335,401 | A | 8/1994 | Hanson | |
| 5,467,511 | A | 11/1995 | Kubo | |
| 5,477,593 | A | 12/1995 | Leick | |
| 5,572,774 | A | 11/1996 | Duran | |
| 5,572,777 | A | 11/1996 | Shelton | |
| 6,049,950 | A * | 4/2000 | Cavallo | F16G 11/101 24/170 |
| 6,076,241 | A | 6/2000 | Borel | |
| 6,094,787 | A | 8/2000 | Chang | |
| 6,192,241 | B1 | 2/2001 | Yu | |
| 6,192,559 | B1 | 2/2001 | Munsell | |
| 6,282,817 | B1 | 9/2001 | Curet | |
| 6,334,240 | B1 | 1/2002 | Li | |
| 6,339,867 | B1 | 1/2002 | Azam | |
| 6,438,871 | B1 | 8/2002 | Culverwell | |
| 6,588,079 | B1 | 7/2003 | Manzano | |
| 6,622,358 | B1 | 9/2003 | Christy | |
| 6,729,000 | B1 | 5/2004 | Liu | |
| 6,735,829 | B2 | 5/2004 | Hsu | |
| 6,938,308 | B2 | 9/2005 | Funk | |
| 7,082,701 | B2 | 8/2006 | Dalgaard | |
| 7,152,285 | B2 | 12/2006 | Liao | |
| 7,313,849 | B2 | 1/2008 | Liu | |
| 7,320,161 | B2 | 1/2008 | Taylor | |
| 7,360,282 | B2 | 4/2008 | Borsoi | |
| 7,591,050 | B2 | 9/2009 | Hammerslag | |
| 7,681,289 | B2 | 3/2010 | Liu | |
| 8,046,937 | B2 | 11/2011 | Beers | |
| 8,141,273 | B2 * | 3/2012 | Stramare | A43C 7/08 24/134 P |
| 8,230,560 | B2 | 7/2012 | Luzlbauer | |
| 8,231,074 | B2 | 7/2012 | Hu | |
| 8,332,994 | B2 * | 12/2012 | Lin | A43C 1/00 24/712.5 |
| 8,371,004 | B2 | 2/2013 | Huber | |
| 8,381,362 | B2 | 2/2013 | Hammerslag | |
| 9,185,948 | B2 | 11/2015 | Ben-Arie | |
| 2002/0002781 | A1 | 1/2002 | Bouirer | |
| 2003/0070269 | A1 * | 4/2003 | Chung | A43C 3/00 24/714.6 |
| 2003/0226284 | A1 | 12/2003 | Grande | |
| 2004/0148741 | A1 * | 8/2004 | Hsiao | A43C 11/1406 24/68 SK |
| 2004/0226189 | A1 * | 11/2004 | Semitka | A43C 3/00 36/50.5 |
| 2005/0005477 | A1 * | 1/2005 | Borsoi | A43C 7/00 36/50.1 |
| 2006/0213085 | A1 | 9/2006 | Azam | |
| 2007/0169380 | A1 | 7/2007 | Borsoi | |
| 2008/0250618 | A1 | 10/2008 | Stramare | |
| 2009/0172929 | A1 | 7/2009 | Hwang | |
| 2010/0115744 | A1 | 5/2010 | Fong | |
| 2011/0067211 | A1 * | 3/2011 | Huber | A43B 5/0401 24/712.1 |
| 2011/0094072 | A1 | 4/2011 | Lin | |
| 2013/0160256 | A1 * | 6/2013 | Waldman | A43C 7/04 24/712.6 |
| 2014/0208551 | A1 * | 7/2014 | Ben-Arie | A43C 7/04 24/712.9 |
| 2015/0216264 | A1 * | 8/2015 | Kim | A43C 7/00 24/712.7 |
| 2016/0374432 | A1 * | 12/2016 | Park | A43C 7/00 24/324 |

* cited by examiner

LACE RATCHETING DEVICE—METAL JACKET

CROSS-REFERENCE TO RELATED APPLICATIONS

This Application is Continuation In Part of application Ser. No. 15/722,755 Filed on Oct. 2, 2017.

FEDERALLY SPONSORED RESEARCH

Not Applicable

SEQUENCE LISTING OR PROGRAM

Not Applicable

FIELD OF THE INVENTION

The invention is related to devices for fastening and keeping fastened laces, chords, ropes, strings and alike.

BACKGROUND OF THE INVENTION—PRIOR ART

Many devices were invented for shoe lace tightening. The most commercially successful is U.S. Pat. No. 6,339,867 by Azam which is widely used in fastening laces of skiing and skates boots. The tightening principle is a spring loaded gear wheel which can move in wedge shaped passage which widens forwards and narrows backwards. The laces pass through that passage and can be fastened by pulling the laces forwards which in turn pulls forwards the gear wheel towards the wider part of the passage where the laces are free to move. When the pulling stops the laces pull the gear wheel backwards, which narrows the passage and blocks the laces' backwards motion. The laces can be released by pulling the gearwheel forwards with a knob. There are few noticeable disadvantages to this popular invention. The device must be installed on heavy-solid footwear which eliminates its use with regular shoes and the user must constantly pull the knob to keep the releasing. In addition, the teeth of gearwheel and opposite teeth cause severe lace wear. Similar approach is taken in U.S. Pat. No. 7,360,282 by Borsoi and in U.S. Pat. No. 8,141,273 by Stramare. The lace buckle device described in U.S. Pat. No. 6,334,240 by Li is used widely in coat laces. It has a lace passage controlled by a spring loaded piston that blocks lace motion when the spring is released. Except for the similar name there is no similarity to our invention. This buckle controls only one lace and does not have a ratchet operation at all. When the user wants to release or fasten the lace the user has to press the spring loaded piston, release the lace and pull at the same time. When the spring is released, the buckle returns to b the lace. Similar devices are sold as "shoe buckles" for fastening shoe laces. The main disadvantage of such shoe buckles is that they do not have a ratcheting operation, which enables one to fasten the laces just by pulling. The shoe buckles require one to fasten the laces with one hand while keeping the buckle in position with the other hand and then switching the buckle into position. This results in cumbersome and inefficient fastening.

In U.S. Pat. No. 6,729,000 Liu uses for lace tightening a teethed rotating bar. In U.S. Pat. No. 6,076,241 by Borel and in several others such as in U.S. Pat. No. 6,622,358 to Christy and in U.S. Pat. No. 6,192,241 by Yu et al. use fastening devices which are based on pipes or channels which have diagonal teeth to block reverse motion of the lace. The pipes are installed on the shoes in different locations.

In U.S. Pat. No. 8,371,004 Huber teaches a lace mechanism. Huber's mechanism employs a pair of spring loaded pivoted arms which have sets of sharp teeth that when pressed against the laces block their motion in both directions. Thus, Huber's mechanism is not a lace ratchet mechanism because it does not allow further lace tightening once it is. In its state, the laces are released in both directions simply by pressing the arms of Huber's mechanism. Huber's mechanism is impractical because the sharp teeth tend to cause a lot of lace wear when the laces are fastened before. Huber's mechanism structure is complex and expensive to manufacture. In addition, similar to the lace buckle, the user needs to fasten both laces with one hand while pressing the arms with the second hand to keep the mechanism in position. In U.S. Pat. No. 8,332,994 Jih-Liang Lin teaches a shoe lace fastener which fasten the lace using jagged arm on top and jagged base on bottom. The device structure includes many complex parts and is expensive to manufacture. Such a structure also is impractical because it will wear the lace very quickly. In U.S. Pat. No. 8,381,362 to Hammerslag et al. teaches Real based closure system. U.S. Pat. No. 8,332,994 to Lin teaches Shoelace with shoelace fastener. U.S. Pat. No. 8,141,273 to Stramare et al. describes Shoes with directional conditioning device for laces. U.S. Pat. No. 8,231,074 to Hu et al. describes Lace winding device for shoes. U.S. Pat. No. 8,230,560 to Luzlbauer teaches Fastening system for shoes.

U.S. Pat. No. 9,185,948 to Ben-Arie describes a Buckle Lace Fastening Device (BLFD) which also enables lace ratcheting. However, the BLFD is using resilient gates which do not rotate but bend. In addition, the mechanism of the BLFD, which is based on rotating the gripping wall is entirely different from the mechanism of the current invention.

U.S. Pat. No. 8,046,937 to Beers et al. describes an Automatic lacing system. U.S. Pat. No. 7,681,289 to Liu describes a Fastener for fasting together two lace systems. U.S. Pat. No. 7,591,050 to Hammerslag describes a Footwear lacing system. U.S. Pat. No. 7,320,161 to Taylor describes a Lace tying device. U.S. Pat. No. 7,313,849 to Liu describes a Fastener for lace. U.S. Pat. No. 7,152,285 to Liao describes a Shoe lace fastening device. U.S. Pat. No. 7,082,701 to Dalgaard describes Footwear variable tension lacing systems. U.S. Pat. No. 6,938,308 Funk describes a lace securing and adjusting device. U.S. Pat. No. 6,735,829 Hsu describes a U shaped lace buckle. In U.S. Pat. No. 6,588,079 to Manzano describes a Shoelace fastening assembly. U.S. Pat. No. 6,438,871 to Culverwell describes Footwear fastening. U.S. Pat. No. 6,192,559 to Munsell Jr. describes a Shoelace fastening apparatus. U.S. Pat. No. 6,094,787 to Chang describes a Fastening device. U.S. Pat. No. 5,572,777 to Shelton describes a Shoelace tightening device. U.S. Pat. No. 5,572,774 to Duren teaches a Shoe fastening attached device. U.S. Pat. No. 5,467,511 to Kubo describes a Shoelace fastening device. U.S. Pat. No. 5,335,401 to Hanson teaches a Shoelace tightening and device. U.S. Pat. No. 5,295,315 to Osawa et al. describes a Shoe fastening device and plate shaped member thereof. U.S. Pat. No. 5,293,675 to Shai describes a Fastener for shoelace. U.S. Pat. No. 5,293,669 to Sampson teaches a Multiuse fastener system. U.S. Pat. No. 5,230,171 to Cardaropoli teaches a Shoe fastener. U.S. Pat. No. 5,203,053 to Rudd teaches a Shoe fastening device. U.S. Pat. No. 5,177,882 to Berger teaches a Shoe with central fastener. U.S. Pat. No. 5,119,539 to Curry teaches a Lace fastener. U.S. Pat. No. 5,109,581 to Gould teaches a Device and method for securing a shoe. U.S. Pat. No. 4,991,273 to Huttle teaches Shoe lace fastening. U.S. Pat. No. 4,648,159 to Dougherty teaches a Fastener for lace or rope or the like. U.S. Pat. No. 4,616,432 to Bunch et al. teaches a Shoe upper with lateral fastening arrangement. U.S. Pat. No. 4,507,878 to Semouha teaches a Fastener mechanism. U.S. Pat. No. 4,458,373 to Maslow teaches Laced shoe and method for tying shoelaces. U.S. Pat. No. 4,261,081 to Lott teaches a Shoelace tightener. U.S. Pat. No. 4,130,949 to Seidel teaches Fastening means for sports shoes. U.S. Pat. No. 4,125,918 to Baumann teaches a Fastener for lace shoes. U.S. Pat. No. 4,071,964 to Vogiatzis teaches a Footwear fastening system. U.S. Pat. No. 5,097,573 to Gimeno teaches Fastening Device for Lace Up Shoes. U.S. Pat. No. 5,001,847 to Waters teaches a Lace Fastener. U.S. Pat. No. 5,477,593 to Leick teaches a Lace Device. U.S. Pat. No. 6,282,817 to Curet teaches an Apparatus and Method for Lacing.

US PATENT APPLICATIONS

In US 2011/0094072 to Lin describes a Shoelace with Shoelace Fastener. In US 2010/0115744 to Fong describes a Lace Fastener. In US 2009/0172929 to Huang describes a Device for tying Shoe laces. In US 2008/025068 to Stramare describes a Shoe with Directional Conditioning Device for lace or the like. In US 2007/0169380 to Borsoi teaches a Device for B Flexible Strands. In US 2006/0213085 to Azam teaches an Article for Footware with Linkage Tightening Device. In US 2005/0005477 to Borsoi teaches a Lace B Device. In US 2003/0226284 to Grande teaches a Lacing System For Skates. In US 2002/0002781 to Bourier teaches a Lace Tightening Device Having a Pocket for Storing a B Element.

BRIEF SUMMARY OF THE INVENTION

In conclusion, all the above inventions do not propose a Lace Fastening Device which combines all of the following desired properties which we included in our invention:

1. Our Lace Ratcheting Device (LRD) enables users to fasten regular laces by a unidirectional ratchet operation, i.e. the user has just to pull the lace and the lace remains fully fastened after the pulling stops until the user releases it.
2. The lace can be manually released easily and quickly by the user.
3. The device has a simple structure, which is suited for low cost manufacturing from plastics.
4. Repeated use of the device causes minimal lace wear that is achieved by the special structure of the turning gate which has at its front side only one sharp blade with a smooth side plane. The blade does not wear the lace when it blocks the lace because it just pressurizes it against the opposite gripping wall and it does not cut into the lace. Also, when the lace slides forward the blade turns forwards and the lace slides engaging the smooth side of the blade.
5. The device can fasten any standard lace and can be easily installed on footwear, garments or other objects.
6. The tapered front end of the LRD's turning gate which controls the lace was covered with sheet metal jacket in order to sharpen its blade and protect it against breaking and wearing.
7. Another significant innovation is the introduction of a clasp which is attached to the LRD and ties to the LRD one or two loose ends of the laces. Other lace fastening devices employ separate clasps which ties the two loose front ends of the lace. But such a separate clasp dangles freely on top of the footwear.

The invention includes various lace ratcheting configurations of a basic lace ratcheting device. These configurations facilitate easy fastening and keeping fastened of: laces, ropes, strings and alike. The basic Lace Ratcheting Device (LRD) is small in dimensions and can be installed on shoes or on other objects which need fastening of laces, ropes, strings and alike. The LRD can be used to fasten laces simply by inserting the laces into LRDs and pulling them. The LRD has a self locking ratcheting mechanism what it means is a mechanism that automatically restricts the lace motion backwards when the lace is pulled backwards and the mechanism applies a blocking force in proportion to pulling force. The ratcheting mechanism has two states: "active" and "inactive". In the active state the device works as a lace ratchet i.e. allowing the lace to be pulled forwards but blocks or severely restricts any lace motion backwards. After the user has fastened the laces they remain fastened until the mechanism is switched into an inactive state. In the inactive state the lace is allowed to move freely forwards and backwards. Each LRD has a channel for fastening one lace. In one embodiment of the LRD, the channel comprises of four walls: a gripping wall, a top wall opposite to the gripping wall, a lower side wall approximately normal to the gripping wall and an upper side wall opposite to the lower side wall. A turning gate (made of solid material) is rotatably installed within the channel on a fulcrum i.e. an axle fitted into a bearing. The axle is centered at the turning gate's axis of rotation. The turning gate comprises of a front end and a rear end wherein the axis of rotation is situated between the two ends. The front end is opposite the gripping wall and there is a gap between the front end and the gripping wall. The lace is passing through the gap. The turning gate's rear end serves as a releasing lever. In one embodiment, a preloaded helical torsion spring is mounted on the axle. In other embodiments one could use other kinds of springs. The spring is installed preloaded with a bias which tends to turn the gate in backwards direction i.e. towards an active state in which the front end applies pressure force on the lace which is squeezed in the gap against the gripping wall. Thus, the idle state of the turning gate is in active state and it is switched into inactive state only when the user applies manual pressure on the lever which exceeds the bias and turns the turning gate forwards, thus releasing the pressure force the front end applies on the lace in the gap. The turning gate has a front end which has a single tapered edge i.e. sharp edge with a smooth side i.e. the front end is tapered i.e. sharp and has a smooth side at its lower side. The lace passes through a gap between the front end of the turning gate and the channel's gripping wall situated opposite to the front end of the turning gate. The gap width is controlled by a ratcheting mechanism operated by the lever.

When the ratcheting mechanism is in the active state, the gap is narrowed such that the front end applies a pressure force which is squeezing the lace in the channel with its tapered i.e. sharp edge. At this state the mechanism and acts as a lace ratchet. It means that the turning gate allows forwards fastening motion of the lace but blocks or severely restricts any lace translation in backwards direction. In order to have a ratcheting operation, the turning gate is installed in a forwards leaning diagonal orientation in the channel such that its front end is closer to the gripping wall then its axis of rotation. Also, in a forwards leaning diagonal orientation, the turning gate's front end is closer to the channel's exit than the turning gate's axis of rotation. The ratchet operation of the gate stems from the forward leaning diagonal orientation of the turning gate, which allows forwards lace motion when the lace is moved forwards. Moving forwards the lace which is squeezed in the gap, drags the turning gate's front end forwards due to the friction force which exists between the lace and the front end because of the pressure force applied by the front end on the lace. When the front end moves forwards also the turning gate turns forwards as well. Due to the forwards leaning diagonal state of the turning gate, when its front end is moved forwards it also moves laterally inwards i.e. away from its gripping wall, thus increasing the width of the gap between the front end and its gripping wall which results in diminished pressure force of the front end on the lace. Reduced pressure force on the lace results in reduced friction between the lace and the surface of the gripping wall and also reduced friction between the lace and the front end and enabling (facilitating) even easier forwards motion of the lace.

On the other hand, if the lace moves backwards it also drags the turning gate's front end backwards since the front end is squeezing the lace and has a mutual friction force with the lace. When the front end moves backwards also the turning gate turns backwards as well. Due to the forwards leaning diagonal orientation of the gate, the motion backwards of the front end has also a lateral outwards component which moves the front end towards the gripping wall thus further narrowing the gap which increases the pressure force of the front end on the lace and further restricting backwards lace motion. Thus, in an active state the gate acts as a lace ratchet i.e. allows lace forwards motion but blocks lace's backwards motion. When the ratcheting mechanism is switched into inactive state, the turning gate is turned forwards by the user and the gap is widened more than the lace's width the pressure force of the front end on the lace is diminished and the lace is entirely released because it can move freely forwards or backwards in the channel. The user can easily switch the ratcheting mechanism from active to inactive state simply by manually pressing on the lever, which is the rear end of the turning gate. If the manual pressure is greater than the torsion spring's preloading bias, the gate turns forwards and increases the gap's width, thus inactivating the LRD. When the manual pressure ceases the preloaded torsion spring turns the gate backwards into an active state. The LRD can be manufactured at low cost because it has a simple structure with only few parts, which could be made from plastics. To protect the tapered front end of the turning gate which controls the lace it was covered with sheet metal jacket in order to sharpen its blade and protect it.

The LRD's structure is different from other lace fastening devices in few important aspects. Primarily, the LRD enables a lace ratcheting operation which is "self locking" it means that in the blocked state pulling the blocked lace with more force, only increases also the blocking force. In addition, our LRD was configured to employ a ratcheting mechanism which causes only minimal wear of the lace since it employs in the channel a novel structure with a diagonally forwards leaning rotating gate with a single tapered i.e. sharp front end which has a smooth side at its lower side opposite the gripping wall. When the lace is moved forwards, the tapered i.e. sharp edge at the front end of the turning gate rotates forwards this also turns the smooth side of the tapered i.e. sharp edge to be approximately parallel with the lace and the lace is sliding on the smooth side of the tapered i.e. sharp edge—which does not wear the lace. At the same time, the forwards rotation also widens the gap and reduces lace friction and wear while the lace is moved forwards. Since the lace is blocked from moving backwards, there is no lace wear in the backwards motion as well. In addition, the LRD's gripping wall is manufactured with a smooth surface to minimize lace wear when it moves in the gap as well. In contrast, other lace fastening devices employ gates with serrated surfaces and/or with sharp teeth structures in order to block lace movement in their blocked state. However, sharp teeth structures cause significant lace wear even when they turn into their unblocked state since their teeth remain pointed at the lace and the lace still touches them as it moves even in a wider gap.

A pair of LRDs in a parallel configuration can be used as a shoe "Ratchet Lace Buckle", which is not attached to the shoe but enables fastening two ends of each shoe lace. The LRDs are attached to one another in a parallel configuration of their channels by attaching the LRDs at their gripping walls. Such a shoe buckle, which is not attached to the shoe, enables easy fastening and releasing of the shoe laces. The two gate levers of the turning gates protrude from openings in the channels' top walls, on the two opposite sides of LRD's parallel configuration. This enables the user to unlock both LRDs easily by pressing the levers with two fingers of one hand.

Both of the "Ratchet Buckle" structures of the parallel configuration and a triangular configuration of two LRDs is designed to lie flat on top of the shoe when the laces are fastened. Each of the channels at the entry opening has a recess at the lower side wall. Each of the channels at entry opening also has a rear segment of the lower side wall next to and behind the recess. The laces are inserted into the channel via the recesses. When the lace is fastened on the shoe, the lace applies a downwards force on the recess. The downwards force is countered by a natural reaction upwards force which is applied on the rear segment by the shoe. The downwards force and the reaction upwards force create a moment of force which is equivalent to a torque that tends to turn each of the LRDs in the LRDs' parallel configuration towards the shoe. Hence, the moment of force clutches the LRDs' parallel configuration onto the top the shoe.

In another lacing configuration, two single LRDs can be attached to the two sides of each shoe for fastening of two lace ends of the same lace. A single LRD can also be used to fasten laces of trousers or coats simply by tying one lace end to the LRD and using the LRD to fasten the other lace's end. All the LRD configurations described above can be implemented by LRDs with helical torsion springs manufactured from elastic material wires which have two wire ends. The rear support LRD has a channel attached pin which supports one wire end at the rear side of the turning gate while the second wire end is supported by the turning gate. The frontal support LRD has a channel's top wall support which supports one wire end at the front side of the turning gate while the second wire end is supported by the turning gate.

The LRD has many advantages over previous devices primarily due to its efficient and easy fastening operation by a ratchet mechanism which requires the user just to pull the lace. An important advantage of the LRD is its self locking ratcheting mechanism it means that in the active blocking state pulling the blocked lace with more force, only increases also the blocking force. This prevents the lace from slipping. Once the lace is pulled, it remains fastened until the ratcheting mechanism is switched from active state into inactive state whereby it disables the ratchet mechanism and releases the lace. Another advantage of the LRD is the ability to manually switch the ratcheting mechanisms of two LRDs in parallel configuration and also in triangular configuration from active state into inactive state simply by squeezing the two opposite gate levers using just two fingers of one hand. Additional advantage over all the other lace ratchets is the LRD causes very low wear on the laces because it does not block or restrict the lace movement using jagged surfaces. Handling laces with fastening devices which have jagged surfaces or which have sharp teeth, as all other lace fasteners do, results in fast wear of the laces. The diagonal orientation of the turning gate's tapered front end i.e. the sharp edges at the front ends of the turning gates in the LRDs, cause very little lace wear because each tapered i.e. sharp edge has a smooth side on which the lace slides when it is fastened. The LRD was worn and tested daily by the Applicant for more than two years on various shoes without any noticeable lace wear.

Another recent improvement is the sheet metal covering of the turning gate's front end, which sharpens it and protects it against breaking and wearing.

BRIEF DESCRIPTION OF THE DRAWINGS

FIG. 5 is simplified and the clasp is not included in FIG. 5.

FIG. 6 is simplified and the clasp is not included in FIG. 6.

DETAILED DESCRIPTION OF THE DRAWINGS

Figure 1:
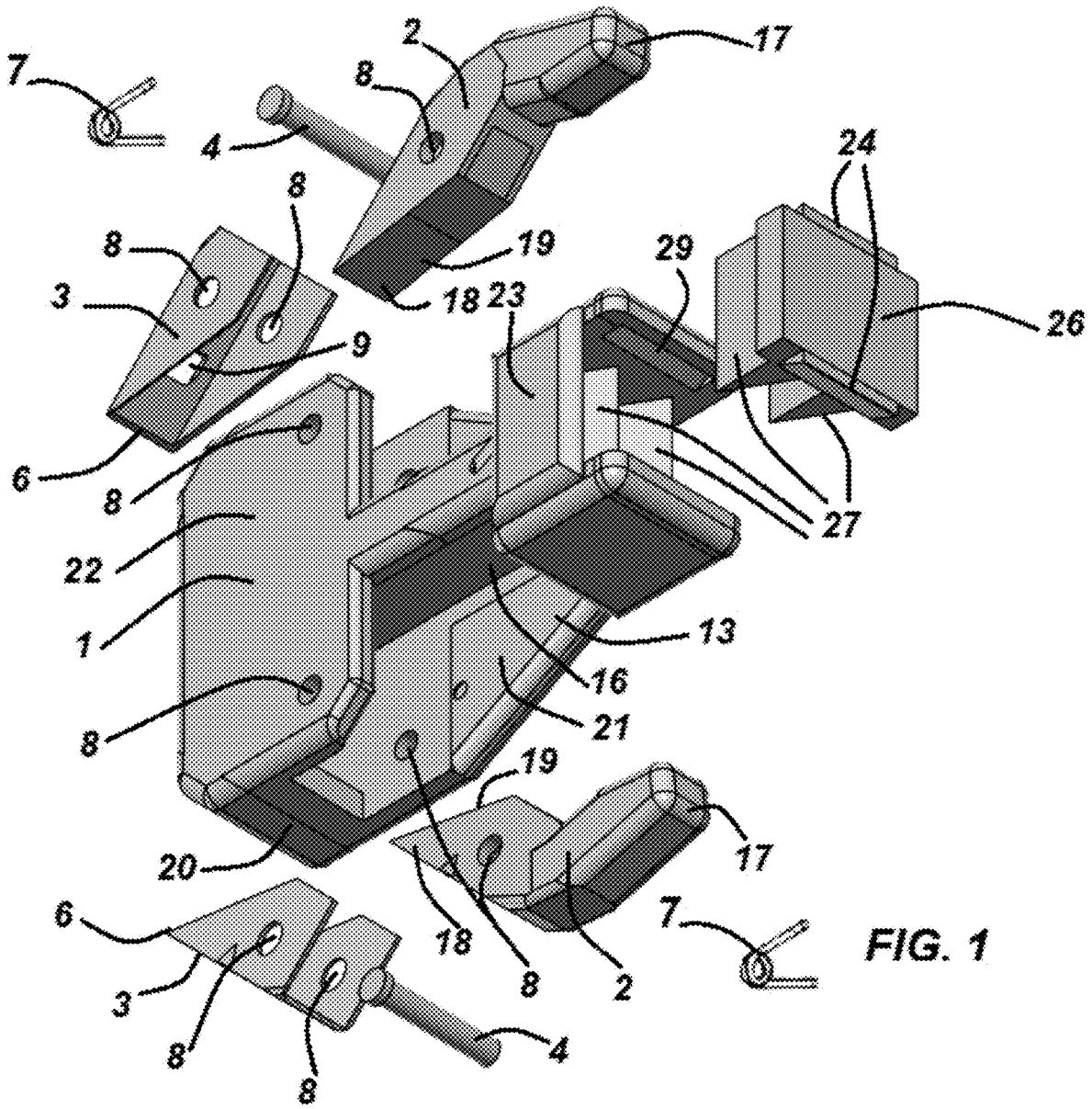
FIG. 1 illustrates a 3D isometric drawing of the parts of an embodiment of a disassembled two joined LRDs (Lace Ratcheting Devices) in a parallel configuration. The joined LRDs are coupled with a lace clasp which ties the loose front ends of the laces. The parts' orientations correspond to their actual orientations in the assembled LRDs' parallel configuration.

FIG. 1 illustrates a 3D isometric drawing of the parts of an embodiment of a disassembled two joined LRDs (Lace Ratcheting Devices) in a parallel configuration 1. The joined LRDs are coupled with a lace clasp which ties the loose front ends of the laces. The parts' orientations correspond to their actual orientations in the assembled LRDs' parallel configuration. The two joint channels of the RLDs in parallel configuration 1 are depicted in FIG. 1 in which the apertures 8 which serve a bearings for the axles 4 are denoted both on the joint channels 1 and on the two turning gates 2. The turning gates 2 have tapered front ends 18 and rear ends 17 which are used for manual release of the laces. The front end of the turning gate 18 also has a smooth side 19 on which the lace slides when it is translated forwards i.e. the direction from the inlet openings 13 to the outlet openings 5. The openings 9 in the turning gates 2 and also in the metal jackets 3 are needed for extending outside the spring's 7 arm which provides frontal support to the turning gate 2. The two outlet openings 5 of the joint channels are shown in FIGS. 3,5,6,7 whereas the two inlet openings 13 are denoted in FIG. 1. The openings 13 are used as recesses for laces' entry while the clamp 23 is used as a rear segment which receives upwards reaction force to the laces pressing downwards force on recesses 13. The clasp 23 which serves also as a rear segment 23 receives reaction force from the footwear below and generates together with recesses 13 a moment force. The moment force turns the LRD's channels downwards towards the top surface of the footwear and keeps the LRD's parallel configuration flat on top of the footwear. The apertures 8 are also denoted on the sheet metal jacket 3 where they are used to anchor the metal jacket 3 to the turning gate 2 by inserting the axles 4 into apertures 8. The turning gate's tapered front end 18 is covered by the metal jacket 3 which protects and sharpens the tapered front end 18 by replacing it with the metal jacket's sharp front end 6. The springs 7 also are mounted on the axles 4. More detailed depictions of all these parts are included in the following figures. The clasp 23 is coupled to the LRDs at their rear end is used to clasp together the loose ends (lace tips) of the laces 14 (shown as 28 in FIGS. 7,8). The clasp 23 includes four sharp wedges 27 which are installed in alternate arrangement such that they leave very narrow passages when the cover 26 is installed. This ensures that the lace tips are tightly clasped when the cover 26 is installed inside the clasp's housing 23. The cover has two side wedges 24 which when inserted into a pair of mating slots 29 secure the cover 26 firmly inside the clasp's housing 23.

Figure 2:
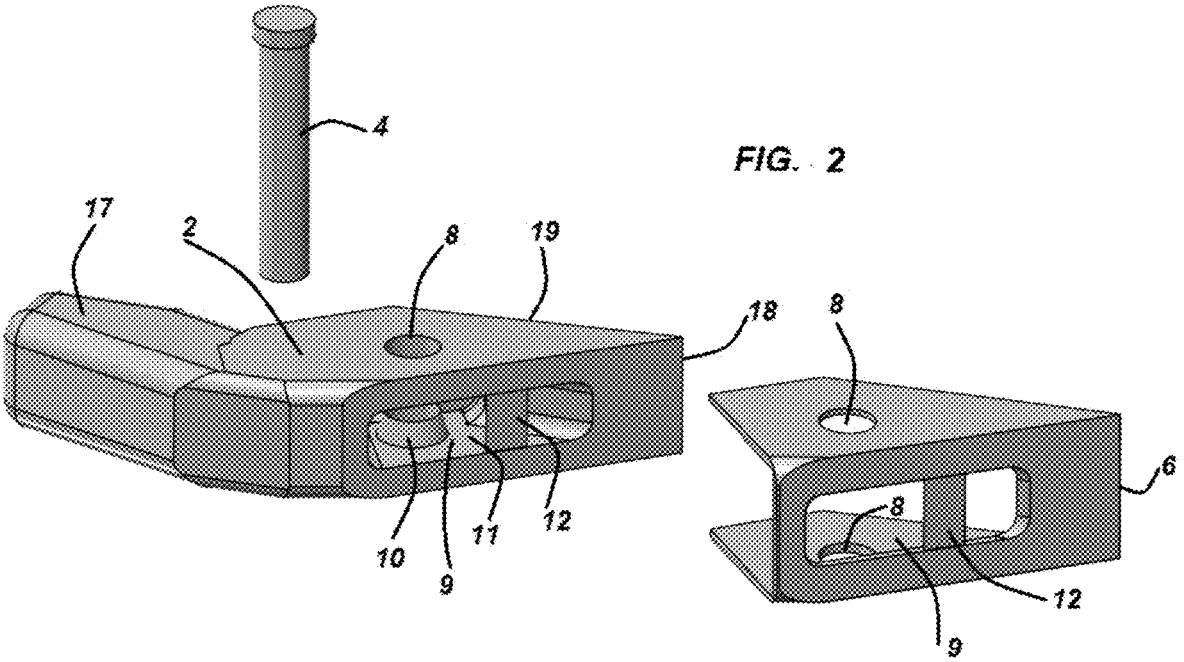
FIG. 2 shows a 3D isometric drawing of the turning gate, the turning gate's sheet metal jacket and the rivet which serves as the axle for the turning gate and also couples the turning gate's sheet metal jacket to the front end of the turning gate.

FIG. 2 shows a 3D isometric drawing of the turning gate 2, the turning gate's sheet metal jacket 3 and the rivet 4 which serves as an axle for the turning gate and also attaches the turning gate's sheet metal jacket to the front end 18 of the turning gate 2 by inserting the rivet 4 into the apertures 8 of the metal jacket 3 and also into the turning gate 2. The turning gate's tapered front end 18 is covered by the metal jacket 3 which protects and sharpens the tapered front end 18 by replacing it with the metal jacket's sharp front end 6. The front end 18 also has a smooth side 19 which facilitates smooth lace sliding. The turning gate 2 has also a rear end 17 which is used for manual lace releasing by deactivating the LRD. The turning gate 2 has a cavity 11 which is configured to house the spring 7 (shown in FIG. 1). In order to hold the spring 7 more firmly during installment, it is being seated on the cone 10 which has the aperture 8 at its center. The opening 9 in the cavity 11 is configured to allow the spring's 7 arm to extend outside the turning gate and to provide frontal support to the turning gate 2. The support 12 is used to strengthen the cavity 11 walls.

Figure 3:
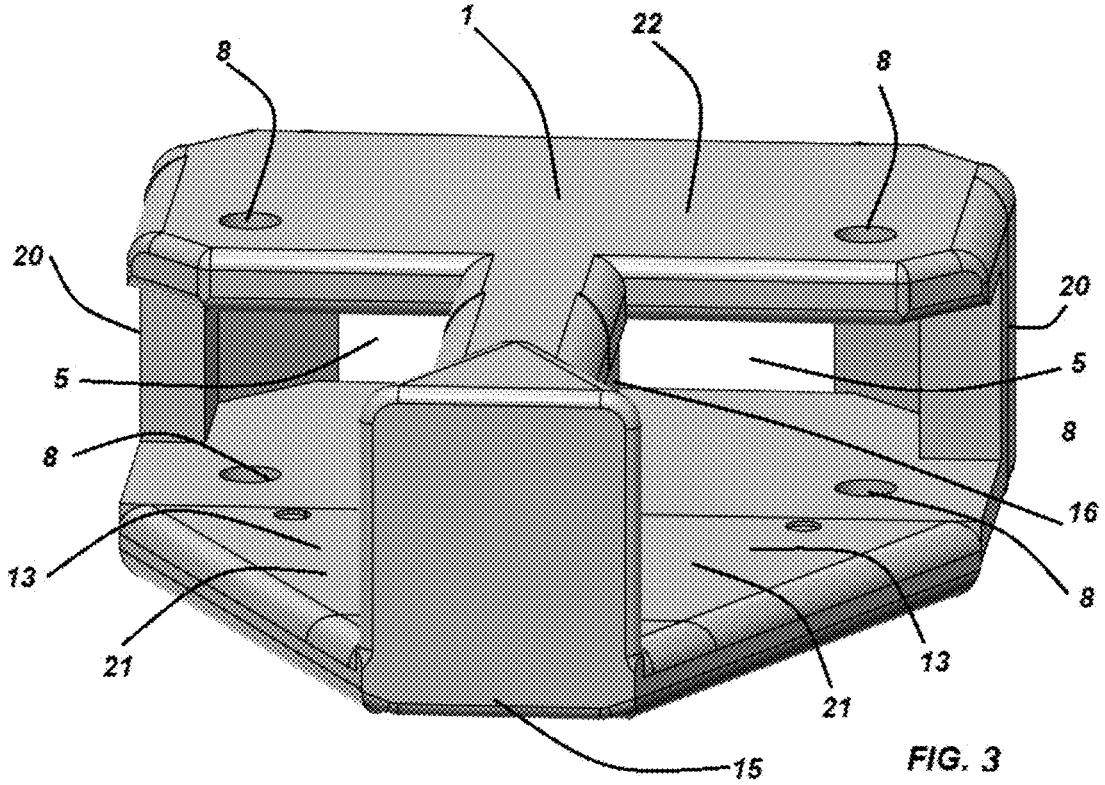
FIG. 3 describes in a 3D isometric drawing, the two joined channels of the LRD's parallel configuration. To display all the features of the LRD it is shown without the clasp.

FIG. 3 describes in a 3D isometric drawing, the two joined channels of the LRD's parallel configuration. In order to display all the features of the LRD it is shown without the clasp 23. The outlet openings 5 of the joint channels are shown in FIG. 3 whereas the inlet openings 13 also are denoted in FIG. 3. The openings 13 are used as recesses for laces' entry while the protrusion 15 which is attached with the clasp 23 is used as a rear segment which creates a moment force when the fastened laces are pressed against the recesses 13. The moment force turns the LRD's parallel channels downwards towards the top surface of the footwear and keeps the LRD's parallel configuration flat on top of the footwear. The apertures 8 serve as bearings for the axles 4 (shown in FIGS. 1, 2). The gripping wall 16 is also shown. The top wall 20 which is opposite the gripping wall 16 is used to provide frontal support to the spring 7. The lower side wall 21 includes the recesses 13 for the laces' entries. The apertures 8 in the upper side wall 22 and in the lower side wall 21 serve as the main bearings for the axles 4. The laces outlets 5 are also denoted in FIG. 3.

Figure 4:
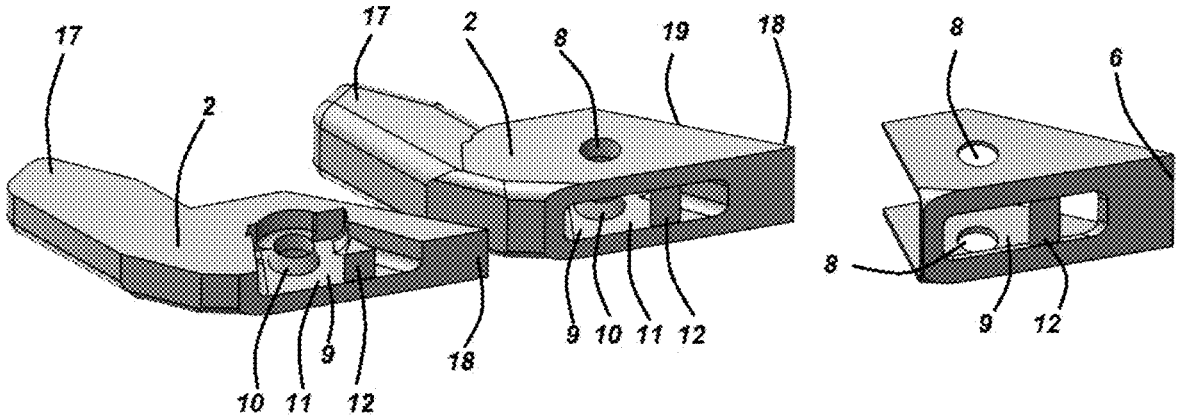
FIG. 4 illustrates in a 3D isometric drawing, the LRD's turning gate, a cross section of the LRD's turning gate and the turning gate's sheet metal jacket.

FIG. 4 illustrates in a 3D isometric drawing, the LRD's turning gate 2, a cross section of the LRD's turning gate 2 and the turning gate's sheet metal jacket 3. When installed, the turning gate's tapered front end 18 is covered by the metal jacket 3 which protects and sharpens the tapered front end 18 by replacing it with the metal jacket's front end 6. The front end 18 also has a smooth side 19 which facilitates smooth lace sliding. The turning gate 2 has also a rear end 17 which is used for manual lace releasing by deactivating the LRD. The turning gate 2 has a cavity 11 which is configured to house the spring 7 (shown in FIG. 1). In order to hold the spring 7 more firmly during installment, it is being seated on the cone 10 which has the aperture 8 at its center. The opening 9 in the cavity 11 is configured to allow the spring's 7 arm extend outside the turning gate 2 and provide frontal support for the turning gate 2. The support 12 is used to strengthen the cavity 11 walls.

Figure 5:
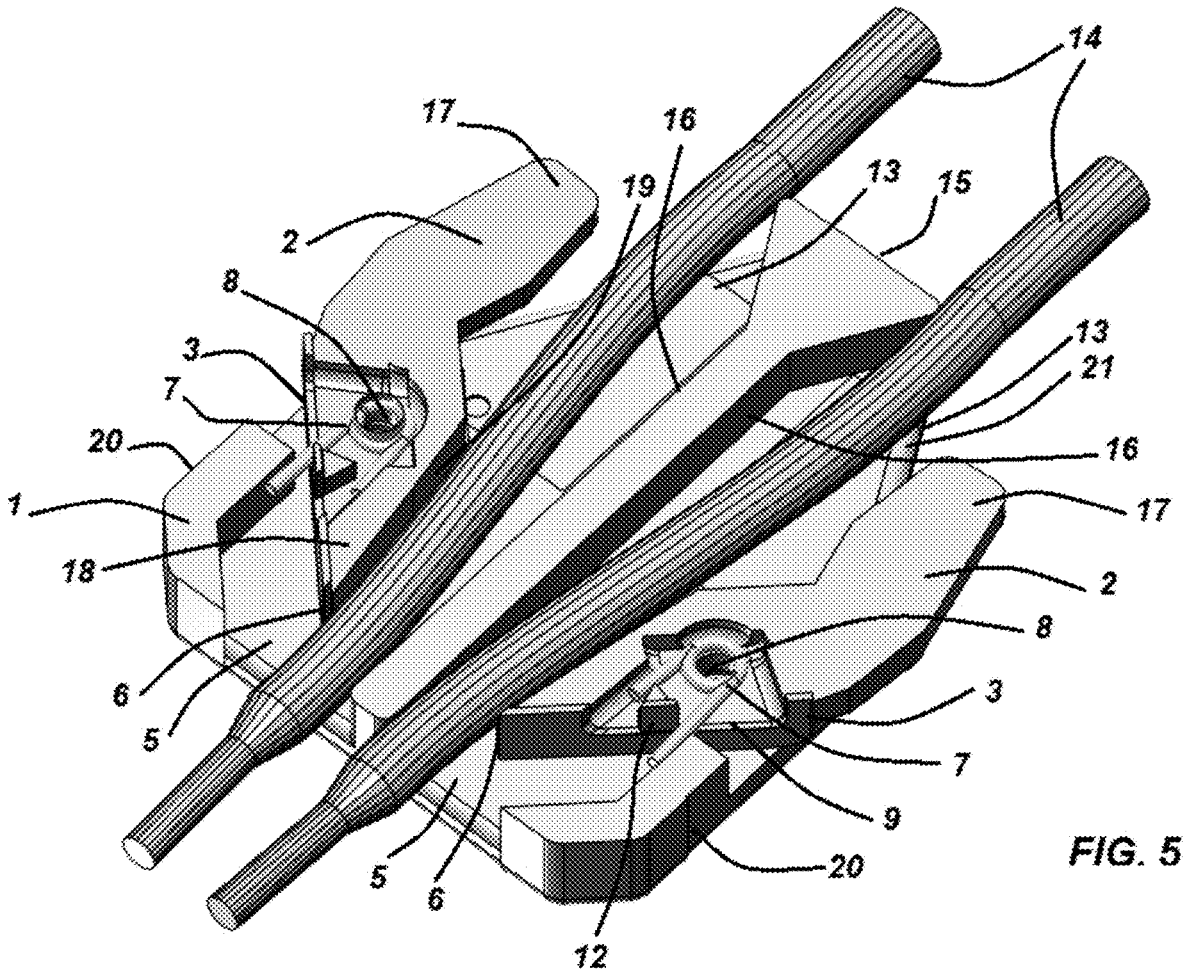
FIG. 5 depicts in a 3D isometric drawing, a cross section of an assembled parallel configuration of two LRDs in an inactive state in which the turning gates are not pressuring the laces in the channels. The drawing includes all the parts of the LRD parallel configuration and also two laces which are passing through the two parallel channels in released state. In order to illustrate the inner workings of the LRD mechanism

FIG. 5 depicts in a 3D isometric drawing, a cross section of an assembled parallel configuration of two LRDs in an inactive state in which the turning gates 2 are not pressuring the laces 14 in the channels. FIG. 5 includes all the parts of the LRDs' parallel configuration and also two laces 14 which are passing through the two parallel channels 1 in a released state. In order to illustrate the inner workings of the LRDs mechanism FIG. 5 is simplified and the clasp 23 is not included in FIG. 5. The two joint channels of the LRDs in parallel configuration 1 are depicted in FIG. 5, in which the apertures 8 which serve a bearings for the axles 4 (shown in FIGS. 1,2) are shown both on the joint channels 1 and on the two turning gates 2. The turning gates 2 have tapered front ends 18 and rear ends 17 which are used for manual release of the laces. The front end 18 also has a smooth side 19 which facilitates smooth lace sliding. The laces 14 also can slide along the smooth surface 16 of the gripping wall. The openings 9 in the turning gates 2 and also in the metal jackets 3 are needed for extending outside the spring's 7 arm which finds at the upper wall 20 a frontal support to the turning gate 2. The outlet openings 5 of the joint channels are shown in FIG. 5 whereas the inlet openings 13 also are denoted in FIG. 5. The openings 13 are used as recesses for laces' entry while the protrusion 15 which is coupled with the clasp 23 (shown in FIGS. 7,8) is used as a rear segment which creates a moment force when the fastened laces 14 are pressed against the recesses 13 in the lower side wall 21. The moment force turns the LRD's channels downwards towards the top surface of the footwear and keeps the LRD's parallel configuration flat on top of the footwear. The turning gate's tapered front end 18 is covered by the metal jacket 3 which shields and sharpens the tapered front end 18 by replacing it with the metal jacket's sharp front end 6. The springs 7 also are mounted on the axles 4. The two turning gates 2 are shown in cross section in FIGS. 5,6,7. This allows to show the springs 7, the spring openings 9 and the cavities support 12.

FIG. 5 also shows a cross sectional 3D isometric drawing of the turning gate 2, The turning gate 2 has also a rear end 17 which is used for manual lace releasing by deactivating the LRD. In FIG. 5 the rear ends 17 are pressed and deactivate the LRD and therefore the laces 14 are in a released state. The turning gate 2 has a cavity 11 which is configured to house the spring 7. The opening 9 in the cavity 11 is configured to allow the spring's 7 arm extend outside the turning gate 2 to provide frontal support to the turning gate 2 at the upper wall 20 which is opposite the gripping wall 16. The support 12 is used to strengthen the cavity 11 walls.

Figure 6:
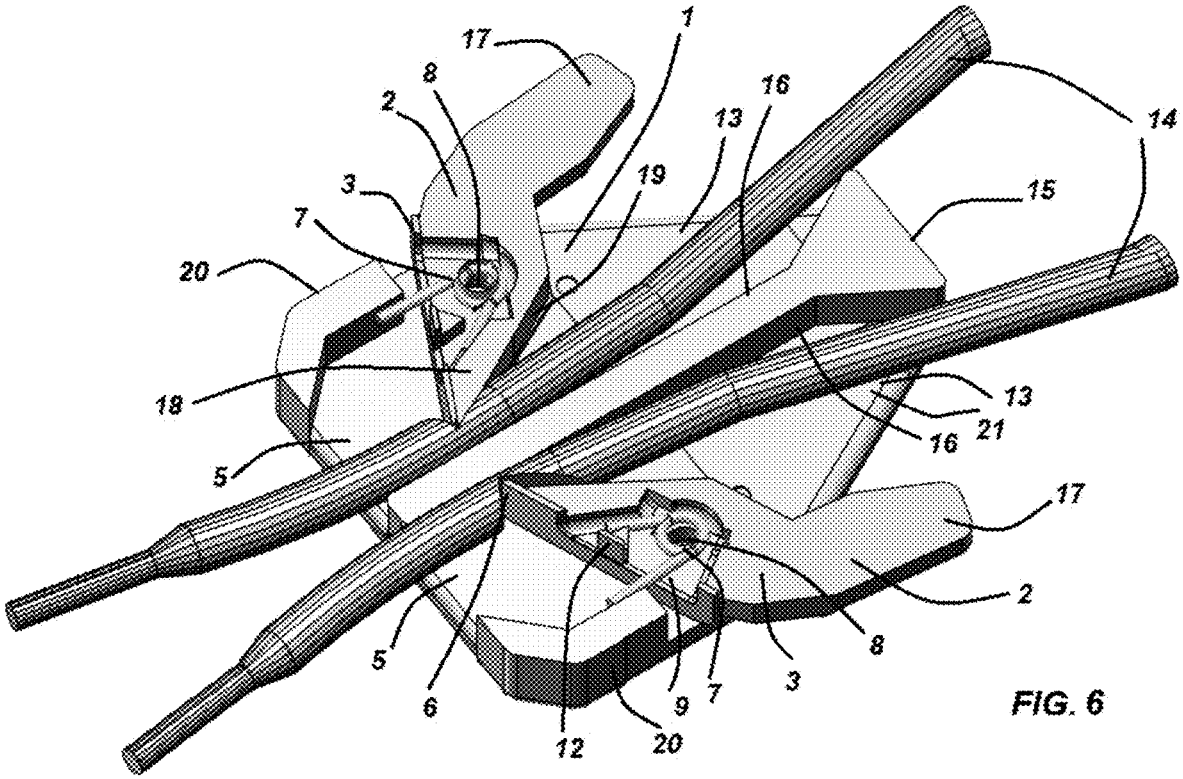
FIG. 6 shows in a 3D isometric drawing, a cross section of an assembled parallel configuration of two LRDs in an active state in which the turning gates are pressuring the laces in the channels. The drawing includes all the parts of the parallel configuration and also two laces which are passing through the two parallel channels in restricted state. In order to illustrate the inner workings of the LRD mechanism

FIG. 6 shows in a 3D isometric drawing, a cross section of an assembled parallel configuration of two LRDs 1 in an active state in which the turning gates 2 are pressuring the laces 14 in the channels. FIG. 6 includes all the parts of the parallel configuration and also two laces 14 which are passing through the two parallel channels in a restricted state because the LRD is in active state. In order to illustrate the inner workings of the LRDs mechanism FIG. 6 is simplified and the clasp 23 is not included in FIG. 6.

The two joint channels of the RLDs in parallel configuration 1 are depicted in FIG. 6, in which the apertures 8 which serve a bearings for the axles 4 (shown in FIGS. 1,2) are shown both on the joint channels 1 and on the two turning gates 2. The turning gates 2 (shown as cross sections) have tapered front ends 18 and rear ends 17 which are used for manual release of the laces. The front ends 18 also have smooth sides 19 which facilitate smooth lace sliding. The laces 14 can also slide along the smooth surface 16 of the gripping wall. The openings 9 in the turning gates 2 and also in the metal jackets 3 are needed for extending outside the spring's 7 arm, which provides frontal support to the turning gates 2 at the upper walls 20. The outlet openings 5 of the joint channels are shown in FIG. 6 whereas the inlet openings 13 also are denoted in FIG. 7. The openings 13 are used as recesses of the lower side wall 21, for laces' entry while the protrusion 15 which is coupled with the clasp 23 (shown in FIGS. 7,8) is used as a rear segment which creates a moment force when the fastened laces 14 are pressed against the recesses 13. The moment force turns the LRD's channels downwards towards the top surface of the footwear and keeps the LRD's parallel configuration flat on top of the footwear. The turning gate's tapered front end 18 is covered by the metal jacket 3 (also shown in cross sectional view) which protects and sharpens the tapered front end 18 by replacing it with the metal jacket's front end 6. FIG. 6 shows the LRD in active state in which the front ends 6 are pressuring the laces 14 against the gripping wall 16 and restrict their motion backwards i.e. from left to right in FIG. 6. When the laces 14 are pulled forwards they slide smoothly with minimum wear while engaging with the smooth sides 19 of the front ends 18 and also engaging the smooth surface of the gripping wall 16. The springs 7 also are mounted on the axles 4.

Figure 7:
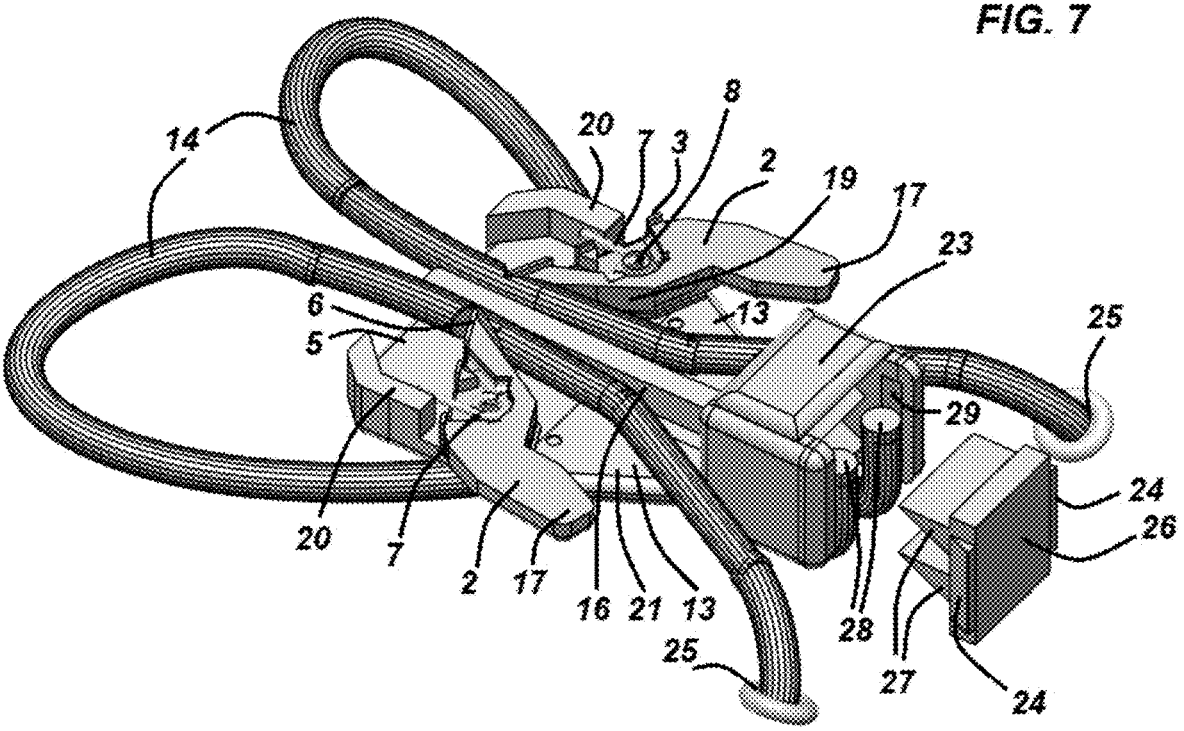
FIG. 7 shows in a 3D isometric drawing a cross section of an assembled parallel configuration of two LRDs in an active state in which the turning gates are pressuring the laces in the channels. The drawing includes all the parts of the parallel configuration and also two laces which are passing through the two parallel channels in restricted state. The two laces loop backwards and are tied at the clasp which is attached behind to the LRDs.

FIG. 6 shows a cross sectional 3D isometric drawing of the turning gate 2, The turning gate 2 has also a rear end 17 which is used for manual lace releasing by deactivating the LRD. In FIG. 7 the rear end 17 is not pressed and therefore activates the LRDs and the front ends 6 pressurize the laces 14 against the gripping walls 16 and the laces 14 are in restricted states. The turning gate 2 has a cavity 11 which is configured to house the spring 7. The opening 9 in the cavity 11 is configured to allow the spring's 7 arm extend outside the turning gate 2 to provide frontal support to the turning gate 2 at the top wall 20. The support 12 is used to strengthen the cavity 11 walls.

Figure 8:
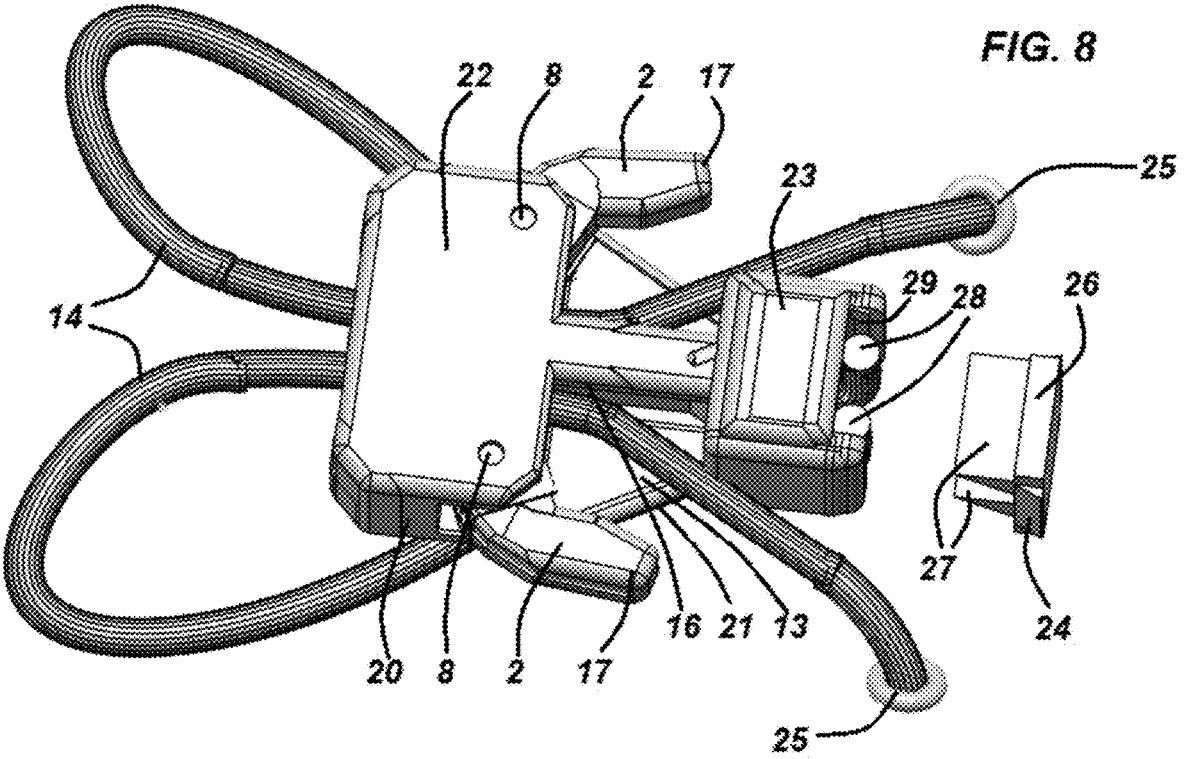
FIG. 8 shows in a 3D isometric drawing of an assembled parallel configuration of two LRDs in an active state in which the turning gates are pressuring the laces in the channels. The drawing includes all the parts of the parallel configuration and also two laces which are passing through the two parallel channels in a restricted state. The two laces loop backwards and are tied at the clasp which is attached behind to the LRDs.

FIG. 7 shows in a 3D isometric drawing, a cross section of an assembled parallel configuration of two LRDs 1 in an active state in which the turning gates 2 are pressuring the laces 14 in the channels. FIG. 7 includes all the parts of the parallel configuration and also two laces 14 which are passing through the two parallel channels in a restricted state because the LRD is in active state. In order to illustrate the inner workings of the LRDs mechanism clasp 23 is also included in FIG. 7. As illustrated in FIGS. 7,8 the front loose ends of laces 14 loop backwards underneath the parallel RLDs configuration 1 and the laces' loose front ends 28 arrive at the bottom of the clasp 23 which is coupled with the parallel configuration of the parallel configuration of the RLDs 1 at its rear end. The clasp 23 which is coupled to the LRDs at their rear end is used to clasp together the lace tips i.e. the loose ends of the laces 14 (shown as 28 in FIGS. 7,8). The clasp 23 includes four sharp wedges 27 which are installed in alternate arrangement such that they leave very narrow passages when the cover 26 is installed. This ensures that the lace tips are tightly clasped when the cover 26 is installed inside the clasp's housing 23. The cover has two side wedges 24 which when inserted into a pair of mating slots 29 secure the cover 26 firmly inside the clasp's housing 23. Initially, before engaging with the LRDs' parallel configuration 1, the two laces 14 exit from the footwear at exits 25.

The two joint channels of the RLDs in parallel configuration 1 are depicted in FIG. 7, in which the apertures 8 which serve a bearings for the axles 4 (shown in FIGS. 1,2) are shown both on the joint channels 1 and on the two turning gates 2. The turning gates 2 (shown as cross sections) have tapered front ends 18 and rear ends 17 which are used for manual release of the laces. The front ends 18 also have smooth sides 19 which facilitate smooth lace sliding. The laces 14 can also slide along the smooth surface 16 of the gripping wall. The openings 9 in the turning gates 2 and also in the metal jackets 3 are needed for extending outside the spring's 7 arm, which provides frontal support to the turning gates 2 at the upper walls 20. The outlet openings 5 of the joint channels are shown in FIG. 7 whereas the inlet openings 13 also are denoted in FIG. 7. The openings 13 are used as recesses of the lower side wall 21 for laces' entry while the protrusion 15 which is coupled with the clasp 23 (shown in FIGS. 7,8) is used as a rear segment which creates a moment force when the fastened laces 14 are pressed against the recesses 13. The moment force turns the LRD's channels downwards towards the top surface of the footwear and keeps the LRD's parallel configuration flat on top of the footwear. The turning gate's tapered front end 18 is covered by the metal jacket 3 (also shown in cross sectional view) which protects and sharpens the tapered front end 18 by replacing it with the metal jacket's front end 6. FIG. 7 shows the LRD in active state in which the front ends 6 are pressuring the laces 14 against the gripping wall 16 and restrict their motion backwards i.e. from left to right in FIG. 7 while allowing the laces to move forwards i.e. from right to left in FIG. 7. When the laces 14 are pulled forwards they slide smoothly with minimum wear while engaging with the smooth sides 19 of the front ends 18 and also engaging the smooth surface of the gripping wall 16. The springs 7 also are mounted on the axles 4.

FIG. 7 shows a cross sectional 3D isometric drawing of the turning gate 2, The turning gate 2 has also a rear end 17 which is used for manual lace releasing by deactivating the LRD. In FIG. 7 the rear end 17 is not pressed and therefore activates the LRDs and the front ends 6 pressurize the laces 14 against the gripping walls 16 and the laces 14 are in restricted states. The turning gate 2 has a cavity 11 which is configured to house the spring 7. The opening 9 in the cavity 11 is configured to allow the spring's 7 arm extend outside the turning gate 2 to provide frontal support to the turning gate 2 at the top wall 20. The support 12 is used to strengthen the cavity 11 walls.

FIG. 8 shows in a 3D isometric drawing, an assembled parallel configuration of two LRDs 1 in an active state in which the turning gates 2 are pressuring the laces 14 in the channels. FIG. 8 includes all the parts of the parallel configuration and also two laces 14 which are passing through the two parallel channels in a restricted state because the LRD is in active state. In order to illustrate the inner workings of the LRDs mechanism clasp 23 is also included in FIG. 8. As illustrated in FIGS. 7,8 the front loose ends of laces 14 loop backwards underneath the parallel RLDs configuration 1 and the laces' loose front ends i.e. lace tips of laces 28 arrive at the bottom of the clasp 23 which is coupled with the parallel configuration of the parallel configuration of the RLDs 1 at its rear end. The clasp 23 which is coupled to the LRDs at their rear end is used to clasp together the loose front ends of the laces 14 (shown as 28 in FIGS. 7,8). The clasp 23 includes four sharp wedges 27 which are installed in alternate arrangement (two wedges opposite to the other two in each side) such that they leave very narrow passages when the cover 26 is installed. This ensures that the lace tips are tightly clasped when the cover 26 is installed inside the clasp's housing 23. The cover has two side wedges 24 which when inserted into a pair of mating slots 29 in the clasp's housing 23 secure the cover 26 firmly inside the clasp's housing 23. Initially, before engaging with the LRDs' parallel configuration 1, the two laces 14 exit from the footwear at exits 25.

The two joint channels of the RLDs in parallel configuration 1 are depicted in FIG. 8, in which the apertures 8 which serve a bearings for the axles 4 (shown in FIGS. 1,2) are shown on the joint channels 1. The turning gates 2 have rear ends 17 which are used for manual release of the laces. The inlet openings 13 also are denoted in FIG. 8. The openings 13 are used as recesses of the lower side wall 21 for laces' entry while the protrusion 15 which is coupled with the clasp 23 (shown in FIGS. 7,8) is used as a rear segment which creates a moment force when the fastened laces 14 are pressed against the recesses 13. The moment force turns the LRD's channels downwards towards the top surface of the footwear and keeps the LRD's parallel configuration flat on top of the footwear. FIG. 8 shows the LRD in active state in which the front ends 6 are pressuring the laces 14 against the gripping wall 16 and restrict their motion backwards i.e. from left to right in FIG. 8 while allowing the laces to move forwards i.e. from right to left in FIG. 8. When the laces 14 are pulled forwards they slide smoothly with minimum wear while engaging with the smooth sides 19 of the front ends 18 and also engaging the smooth surface of the gripping wall 16.

FIG. 8 shows a 3D isometric drawing of the turning gate 2, The turning gate 2 has a rear end 17 which is used for manual lace releasing by deactivating the LRD. In FIG. 8 the rear end 17 is not pressed and therefore activates the LRDs and the front ends 6 pressurize the laces 14 against the gripping walls 16 and the laces 14 are in restricted states.

What is claimed is:

1. A ratcheting device for releasably fastening a lace, the ratcheting device comprising:

a channel being configured to receive a portion of the lace therethrough;

said channel further includes a gripping wall being adapted with a surface configured to engage said lace;

the ratcheting device has an active state and an inactive state; wherein in said active state the ratcheting device is configured to restrict translation of the lace in the channel in a backwards direction and to facilitate translation of the lace in the channel in a forwards direction;

wherein in said inactive state the ratcheting device is configured to facilitate translation of the lace both in said forwards direction and in said backwards direction;

the ratcheting device further comprising:

a turning gate, and a spring;

the turning gate being rotationally engaged with the channel at a fulcrum, wherein the turning gate comprises a front end and a rear end opposite the front end;

the turning gate is installed at a diagonal orientation with respect to the forwards direction; the front end is disposed diagonally within the channel opposite the gripping wall; wherein the lace is configured to pass through a gap between the front end and the gripping wall; wherein the front end is configured to exert a pressure force on the lace when the turning gate is turned backwards; wherein the front end is pressuring the lace against the surface of the gripping wall;

wherein, the front end is configured to increase the pressure force on the lace when the turning gate is turned increasingly backwards, and the front end is configured to reduce the pressure force on the lace when the turning gate is turned increasingly forwards;

at the active state, the front end is configured to exert said pressure force on the lace and the front end is configured to frictionally engage the lace and to turn forwards the turning gate when the lace is translated in said forwards direction; also, at the active state the front end is configured to frictionally engage the lace and to turn backwards the turning gate when the lace is translated in said backwards direction;

wherein, forwards translation of the lace is facilitated by turning increasingly forwards the turning gate and consequently diminishing the pressure force of the front end on the lace; whereas backwards translation of the lace is restricted by turning increasingly backwards the turning gate and consequently increasing the pressure force of the front end on the lace;

at the inactive state of the ratcheting device, the front end is configured not to exert said pressure force on the lace and the lace translation is facilitated both in the forwards direction and in the backwards direction;

the spring is preloaded and configured to apply a backwards turning force on the turning gate causing the front end to apply said pressure force on the lace;

the rear end is being configured as a lever for manually turning the turning gate forwards and diminishing the pressure force exerted by the front end on the lace; wherein, releasing the lace.

2. The ratcheting device of claim 1, wherein said fulcrum comprises an axle which is fitted in a bearing.

3. The ratcheting device of claim 1, wherein said spring is a torsion spring; wherein the torsion spring has a resilient helical wire structure with a first wire end and a second wire end; wherein said torsion spring is installed preloaded with a bias which applies said backwards turning force on the turning gate.

4. The ratcheting device of claim 1, wherein said front end comprises a tapered edge and a smooth side;

wherein, the tapered edge is configured to concentrate said pressure force on the lace when the turning gate is turned backwards and the front end engages the lace;

wherein, the smooth side is configured to engage the lace when the turning gate is turned forwards; wherein, the smooth side is configured to reduce said lace wear when the lace is translated in the forwards direction.

5. The ratcheting device of claim 1, wherein said front end comprises a tapered edge and a smooth side;

wherein, the tapered edge is covered by a sheet metal jacket which covers the tapered edge with a metal tapered edge made of sheet metal.

6. The ratcheting device of claim 1, wherein the surface of the gripping wall comprises a smooth surface; wherein, the smooth surface is configured to reduce said lace wear when the lace is fastened at said active state and also when said lace is translated in said inactive state.

7. The ratcheting device of claim 1, wherein the ratcheting device further comprising one or more bulges disposed on the surface of the gripping wall; wherein said bulge is configured to cause an additional bending of the lace due to said pressure force; wherein, said additional bending increases a mutual friction force between the lace and the surface of the gripping wall when said front end applies said pressure force on the lace.

8. The ratcheting device of claim 1, wherein said ratcheting device further comprising a front spring support;

wherein said first wire end is supported by said channel and said second wire end is supported by said turning gate.

9. A ratcheting system for releasably fastening two laces and thereby achieving a secure attachment of an article about a person or an object, the ratcheting system comprising: a first ratcheting device and a second ratcheting device; the first ratcheting device further comprising:

a first lace, and a first channel being configured to receive a portion of the first lace therethrough;

said first channel further includes a first gripping wall being adapted with a first surface configured to engage said first lace;

the first ratcheting device has a first active state and a first inactive state; wherein in said first active state the first ratcheting device is configured to restrict translation of the first lace in the first channel in a first backwards direction and to facilitate translation of the first lace in the first channel in a first forwards direction;

wherein in said first inactive state the first ratcheting device is configured to facilitate translation of the first lace both in said first forwards direction and in said first backwards direction;

the first ratcheting device further comprising:

a first turning gate, and a first spring;

the first turning gate being rotationally engaged with the first channel at a first fulcrum, wherein the first turning gate comprises a first front end and a first rear end opposite the first front end;

the first turning gate is installed at a first diagonal orientation with respect to the first forwards direction; the first front end is disposed diagonally opposite the first gripping wall within the first channel; wherein the first lace is configured to pass through a first gap between the first front end and the first gripping wall; wherein the first front end is configured to exert a first pressure force on the first lace when the first turning gate is turned first backwards; in addition, when the first turning gate is turned first backwards the first front end is pressuring the first lace against the first surface of the first gripping wall;

wherein, the first front end is configured to increase the first pressure force on the first lace when the first turning gate is turned increasingly first backwards, and the first front end is configured to reduce the first pressure force on the first lace when the first turning gate is turned increasingly first forwards;

at the first active state the first front end is configured to exert said first pressure force on the first lace and the first front end is configured to frictionally engage the first lace and to turn first forwards the first turning gate when the first lace is translated in said first forwards direction; also, at the first active state the first front end is configured to frictionally engage the first lace and to turn first backwards the first turning gate when the first lace is translated in said first backwards direction;

wherein, the first forwards translation of the first lace is facilitated by turning increasingly forwards the first turning gate and consequently diminishing the first pressure force of the first front end on the first lace; whereas backwards translation of the first lace is restricted by turning increasingly backwards the first turning gate and consequently increasing the first pressure force of the first front end on the first lace;

at the first inactive state of the first ratcheting device the first front end is configured not to exert said first pressure force on the first lace; wherein the first lace translation is facilitated both in the first forwards direction and in the first backwards direction;

the first spring is preloaded and configured to apply a first backwards turning force on the first turning gate causing the first front end to apply said first pressure force on the first lace;

the first rear end is being configured as a first lever for manually turning the first turning gate first forwards and diminishing the first pressure force exerted by the first front end on the first lace and releasing the first lace;

the second ratcheting device further comprising:

a second lace, and a second channel being configured to receive a portion of the second lace therethrough;

said second channel further includes a second gripping wall being adapted with a second surface configured to engage said second lace;

the second ratcheting device has a second active state and a second inactive state; wherein in said second active state the second ratcheting device is configured to restrict translation of the second lace in the second channel in a second backwards direction and to facilitate translation of the second lace in the second channel in a second forwards direction;

wherein in said second inactive state the second ratcheting device is configured to facilitate translation of the second lace both in said second forwards direction and in said second backwards direction;

the second ratcheting device further comprising:

a second turning gate, and a second spring;

the second turning gate being rotationally engaged with the second channel at a second fulcrum, wherein the second turning gate comprises a second front end and a second rear end opposite the second front end;

the second turning gate is installed at a second diagonal orientation with respect to the second forwards direction; the second front end is disposed diagonally opposite the second gripping wall within the second channel; wherein the second lace is configured to pass through a second gap between the second front end and the second gripping wall; wherein the second front end is configured to exert a second pressure force on the second lace when the second turning gate is turned second backwards; in addition, when the second turning gate is turned second backwards the second front end is pressuring the second lace against the second surface of the second gripping wall;

wherein, the second front end is configured to increase the second pressure force on the second lace when the second turning gate is turned increasingly second backwards, and the second front end is configured to reduce the second pressure force on the second lace when the second turning gate is turned increasingly second forwards;

at the second active state the second front end is configured to exert said second pressure force on the second lace and the second front end is configured to frictionally engage the second lace and to turn second forwards the second turning gate when the second lace is translated in said second forwards direction; also, at the second active state the second front end is configured to frictionally engage the second lace and to turn second backwards the second turning gate when the second lace is translated in said second backwards direction;

wherein the second forwards translation of the second lace is facilitated by turning increasingly forwards the second turning gate and consequently diminishing the second pressure force of the second front end on the second lace; whereas backwards translation of the second lace is restricted by turning increasingly backwards the second turning gate and consequently increasing the second pressure force of the second front end on the second lace;

at the second inactive state of the second ratcheting device the second front end is configured not to exert said second pressure force on the second lace; wherein, the second lace translation is facilitated both in the second forwards direction and in the second backwards direction;

the second spring is preloaded and configured to apply a second backwards turning force on the second turning gate causing the second front end to apply said second pressure force on the second lace;

the second rear end is being configured as a second lever for manually turning the second turning gate second forwards and diminishing the second pressure force exerted by the second front end on the second lace and releasing the second lace.

10. The ratcheting system of claim 9, wherein said first fulcrum comprises a first axle which is fitted in a first bearing;

wherein, said second fulcrum comprises a second axle which is fitted in a second bearing.

11. The ratcheting system of claim 9, wherein said first spring is a first torsion spring; the first torsion spring has a first resilient helical wire structure with a first front wire end and a first rear wire end; wherein said first torsion spring is installed preloaded with a first bias which is configured to apply said first backwards turning force on the first turning gate;

wherein said second spring is a second torsion spring; the second torsion spring has a second resilient helical wire structure with a second front wire end and a second rear wire end; wherein said second torsion spring is installed preloaded with a second bias which is configured to apply said second backwards turning force on the second turning gate.

12. The ratcheting system of claim 9, wherein said first front end comprises a first tapered edge and a first smooth side; wherein, the first tapered edge is configured to concentrate said first pressure force on the first lace when the first turning gate is turned backwards and the first front end engages the first lace; wherein, the first smooth side is configured to engage the first lace when the first turning gate is turned forwards; wherein, the first smooth side is configured to reduce said first lace wear when the first lace is translated in the first forwards direction;

wherein said second front end comprises a second tapered edge and a second smooth side; wherein, the second tapered edge is configured to concentrate said second pressure force on the second lace when the second turning gate is turned backwards and the second front end engages the second lace; wherein, the second smooth side is configured to engage the second lace when the second turning gate is turned forwards; wherein, the second smooth side is configured to reduce said second lace wear when the second lace is translated in the second forwards direction.

13. The ratcheting device of claim 9, wherein said first front end comprises a first tapered edge and a first smooth side;

wherein, the first tapered edge is covered by a first sheet metal jacket which covers the first tapered edge with a first metal tapered edge made of sheet metal;

wherein said second front end comprises a second tapered edge and a second smooth side;

wherein, the second tapered edge is covered by a second sheet metal jacket which covers the second tapered edge with a second metal tapered edge made of sheet metal.

14. The ratcheting system of claim 9, wherein the first surface of the first gripping wall comprises a first smooth surface; wherein, the first smooth surface is configured to reduce said first lace wear when the first lace is fastened at said first active state and also when said first lace is translated in said first inactive state;

wherein the second surface of the second gripping wall comprises a second smooth surface; wherein, the second smooth surface is configured to reduce said second lace wear when the second lace is fastened at said second active state and also when said second lace is translated in said second inactive state.

15. The ratcheting system of claim 9, wherein the first ratcheting device further comprises a first bulge disposed on the first surface of the first gripping wall; wherein said first bulge is configured to cause a first additional bending of the first lace due to said first pressure force on the first lace; wherein, said first additional bending is configured to increase a first mutual friction force between the first lace and the first surface when said first ratcheting device is in said first active state and said first lace is pulled in said first backwards direction;

wherein the second ratcheting device further comprises a second bulge disposed on the second surface of the second gripping wall; wherein said second bulge is configured to cause a second additional bending of the second lace due to said second pressure force on the second lace; wherein, said second additional bending is configured to increase a second mutual friction force between the second lace and the second surface when said second ratcheting device is in said second active state and said second lace is pulled in said second backwards direction.

16. The ratcheting system of claim 11, wherein said first ratcheting device further comprising a first front spring support; wherein, said first front wire end is supported by said first channel and said first rear wire end is supported by said first turning gate;

wherein, said second ratcheting device further comprising a second front spring support; wherein, said second front wire end is supported by said second channel and said second rear wire end is supported by said second turning gate.

17. The ratcheting system of claim 9, wherein the first channel further comprising a first top wall opposite the first gripping wall and the second channel further comprising a second top wall opposite the second gripping wall; wherein said first ratcheting device and said second ratcheting device are coupled in a parallel configuration by attaching the first gripping wall to the second gripping wall; wherein the first lever is configured to protrude from a first opening in the first top wall which is situated on a first outer side of said parallel configuration and the second lever is configured to protrude from a second opening in the second top wall which is situated opposite to the first top wall on a second outer side of said parallel configuration; wherein, having the first lever opposite to the second lever facilitates single handed manual operation.

18. The ratcheting system of claim 9, wherein said first channel further comprising: a first entry opening and a first lower side wall; the first lower side wall adjacent to the first entry opening comprises a first rear segment of the first lower side wall preceded by a first recess situated in front of said first rear segment of the first lower side wall; wherein said first lace is configured to enter said first channel via said first recess; wherein, when said first lace is fastened on a footwear, said first lace is configured to apply a first downwards force on said first recess; wherein said first downwards force is naturally countered in the opposite direction by a first reaction upwards force configured to be applied by the footwear on said first rear segment; said first downwards force and said first reaction upwards force create a first moment of force which tends to turn said first ratcheting device downwards towards said footwear; wherein, said first moment of force is configured to clutch said first ratcheting device on top of said footwear;

wherein said second channel further comprising: a second entry opening and a second lower side wall; the second lower side wall adjacent to the second entry opening comprises a second rear segment of the second lower side wall preceded by a second recess situated in front of said second rear segment of the second lower side wall; wherein said second lace is configured to enter said second channel via said second recess; wherein, when said second lace is fastened on a footwear, said second lace is configured to apply a second downwards force on said second recess; wherein said second downwards force is naturally countered in the opposite direction by a second reaction upwards force configured to be applied by the footwear on said second rear segment; said second downwards force and said second reaction upwards force create a second moment of force which tends to turn said second ratcheting device downwards towards said footwear; wherein, said second moment of force is configured to clutch said second ratcheting device on top of said footwear.

19. A lace clasping device configured for clasping at least one lace end;

wherein, the lace clasping device is coupled with at least one lace ratcheting device, further comprising:

a clasping structure configured for housing at least one lace end;

a clasping mechanism configured to switch the clasping structure from an open state to a closed state and from the closed state to the open state;

wherein, in the open state the lace ends housed in the clasping structure are not clasped and can be released;

wherein, in the closed state the lace ends housed in the clasping structure are clasped and tied to the clasping structure;

wherein the clasping structure comprising:

two opposite sets of fitting wedges, which can be switched by the clasping mechanism from the open state to the closed state and from the closed state to the open state;

wherein, in the open state the opposite sets of fitting wedges are separated and the lace ends housed in the clasping structure are not clasped and can be released;

wherein, in the closed state the opposite sets of fitting wedges are not separated and pressed one against the other and the lace ends housed in the clasping structure are clasped and tied to the clasping structure.

* * * * *